US005661259A

United States Patent [19]

Cipolla

[11] Patent Number: 5,661,259

[45] Date of Patent: Aug. 26, 1997

[54] VARIABLE SHAPE CONTROL FIN ASSEMBLY FOR WATER VEHICLES

[75] Inventor: Jeffrey L. Cipolla, Newport, R.I.

[73] Assignee: The United States of America as represented by the Secretary of the Navy, Washington, D.C.

[21] Appl. No.: 641,134

[22] Filed: Apr. 22, 1996

[51] Int. Cl.[6] ..... F42B 19/06

[52] U.S. Cl. ..... 114/23; 114/330; 114/144 R

[58] Field of Search ..... 114/23, 20.1, 163, 114/162, 144 R, 274, 280, 282, 330, 331

[56] References Cited

U.S. PATENT DOCUMENTS

| | | | |
|---|---|---|---|
| 3,930,626 | 1/1976 | Croswell, Jr. | 244/44 |
| 4,890,568 | 1/1990 | Dolengowski | 114/246 |
| 4,941,627 | 7/1990 | Moscrip | 244/3.21 |
| 5,114,104 | 5/1992 | Cincotta et al. | 244/219 |
| 5,150,864 | 9/1992 | Roglin et al. | 244/219 |
| 5,186,420 | 2/1993 | Beauchamp et al. | 244/219 |
| 5,254,837 | 10/1993 | Grimaldi et al. | 219/200 |
| 5,366,176 | 11/1994 | Loewy et al. | 244/75 R |
| 5,374,011 | 12/1994 | Lazarus et al. | 244/75 R |
| 5,440,193 | 8/1995 | Barrett | 340/328 |
| 5,549,065 | 8/1996 | Cipolla et al. | 114/23 |
| 5,551,363 | 9/1996 | Cipolla et al. | 114/23 |
| 5,551,364 | 9/1996 | Cipolla et al. | 114/23 |
| 5,551,365 | 9/1996 | Cipolla et al. | 114/23 |

*Primary Examiner*—Michael J. Carone
*Assistant Examiner*—Christopher K. Montgomery
*Attorney, Agent, or Firm*—Michael J. McGowan; Michael F. Oglo; Prithvi C. Lall

[57] ABSTRACT

A control fin assembly for a water vehicle includes a multiplicity of fins connected together and grouped in an array mounted on the vehicle. A portion of the array is of a shape-memory material responsive to heat to assume selected shapes different from the shape of the array portion otherwise. The array portion is electrically conductive and adapted to increase in temperature upon application of electrical current thereto to effect the assumption of the selected shapes.

The invention further relates to a control fin for a water vehicle, at least a portion of the fin being of a shape-memory material responsive to heat to assume selected shapes different from the shape of the fin otherwise, the fin portion being electrically conductive and adapted to increase in temperature upon application of electrical current thereto to effect the assumption of the selected shapes.

2 Claims, 6 Drawing Sheets

VARIABLE SHAPE CONTROL FIN ASSEMBLY FOR WATER VEHICLES

STATEMENT OF GOVERNMENT INTEREST

The invention described herein may be manufactured and used by or for the Government of the United States of America for governmental purposes without payment of any royalties thereon or therefor.

CROSS-REFERENCE TO RELATED PATENT APPLICATIONS

This patent application is co-pending with four related patent applications entitled Water Vehicle And A Directional Control Device Therefor, U.S. Pat. No. 5,549,065; Water Vehicle and a Directional Control Device Therefor, U.S. Pat. No. 5,551,365; Underwater Vehicle And A Combination Directional Control And Cable Interconnect Device, U.S. Pat. No. 5,551,364; and Underwater Vehicle And A Combination Directional Control and Cable Interconnect Means, U.S. Pat. No. 5,551,363; all filed Mar. 27, 1995, in the names of Jeffrey L. Cipolla, et al.

BACKGROUND OF THE INVENTION

1. Field of the Invention

This invention relates to directional control means for a water vehicle, and is directed more particularly to a control fin assembly for a water vehicle having at least a portion thereof underwater during travel of the vehicle through water, the fin assembly being extendible from the vehicle and operative in an underwater environment to maneuver the vehicle.

2. Description of the Prior Art

Current directional control devices for water vehicles are of two basic types, fins and thrusters. Fins typically are mounted at the aft end of the vehicle or, in the case of an underwater vehicle, on the sail or bow. The effect of fins on the directional control of the vehicle is proportional to the flow rate across the fins. Thus, at low speeds the effectiveness of fins is diminished. Thrusters are effective at low speeds because they produce their own flow, but are noisy, consume power, occupy more space, and are more complex and expensive than fins.

There is thus a need for a fin-type control means which is effective at low vehicle speeds.

SUMMARY OF THE INVENTION

It is, therefore, an object of the invention to provide a control fin assembly for a water vehicle, the assembly being effective for directional control at low vehicle speeds.

With the above and other objects in view, as will hereinafter appear, a feature of the present invention is the provision of a control fin assembly for a water vehicle, the assembly comprising a multiplicity of fins connected together and grouped in an array mounted on the vehicle. A portion of the array is of a shape-memory material responsive to heat to assume selected shapes different from the shape of the array portion otherwise. The array portion is electrically conductive and adapted to increase in temperature upon application of electrical currents thereto to effect the assumption of the selected shapes.

In accordance with a further feature of the invention, there is provided a control fin for a water vehicle, at least a portion of the fin being of a shape-memory material responsive to heat to assume selected shapes different from the shape of the fin otherwise, the fin portion being electrically conductive and adapted to increase in temperature upon application of electrical currents thereto to effect the assumption of the selected shapes.

The above and other features of the invention, including various details of construction and combinations of parts, will now be more particularly described with reference to the accompanying drawings and pointed out in the claims. It will be understood the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
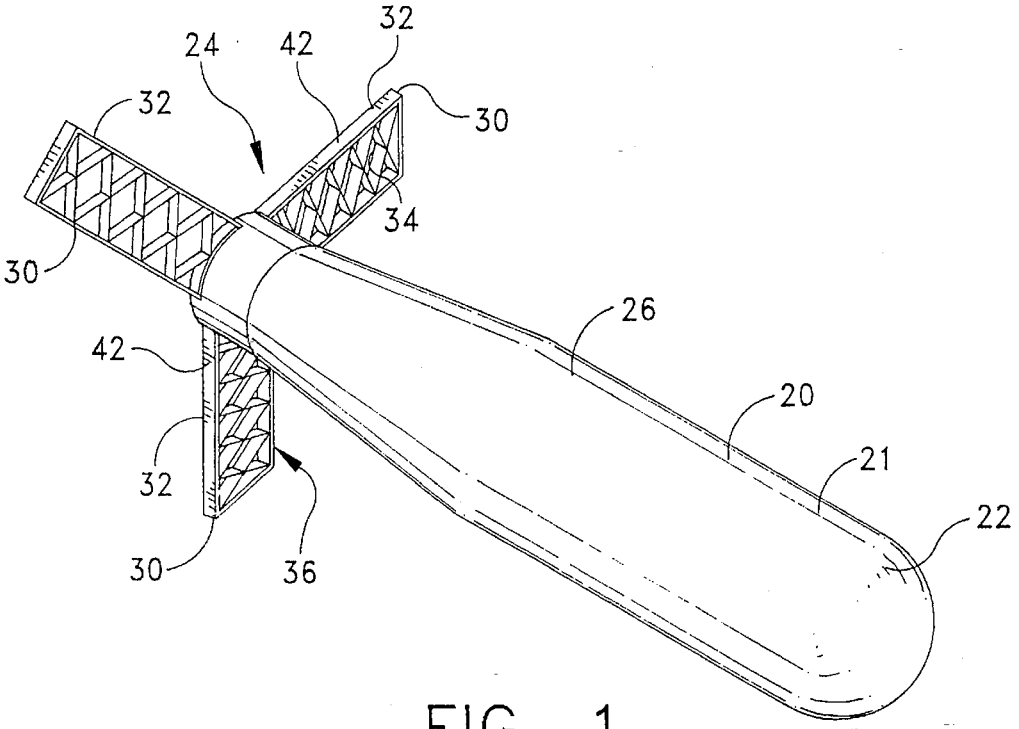
FIGS. 1–3 are perspective diagrammatic views of control fin assemblies illustrative of embodiments of the invention extending from underwater vehicles.
Figure 2:
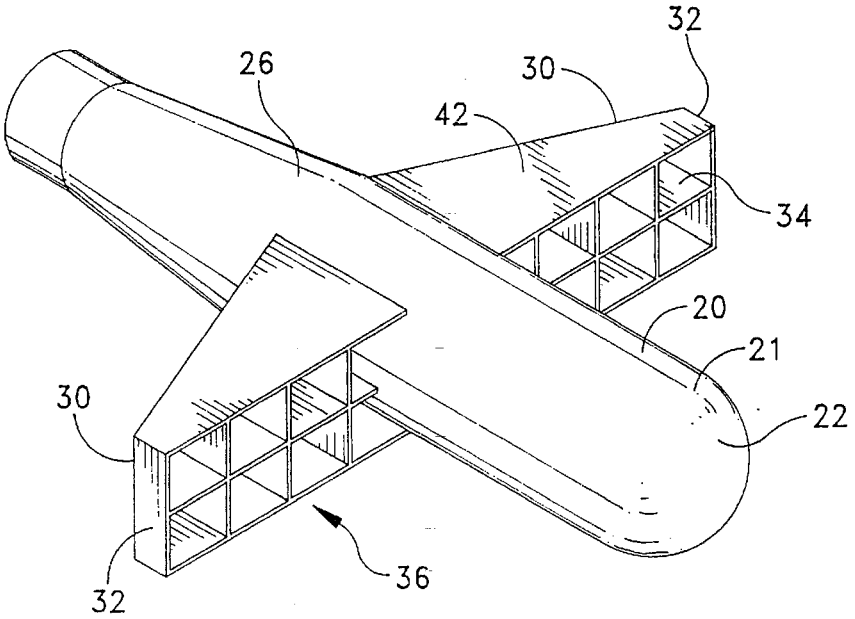

Referring to FIG. 1, it will be seen that an illustrative water vehicle 20 having mounted thereon an illustrative direction control means 30 may comprise an underwater vehicle 21 and a plurality of symmetrically disposed arrays 32 extending from an aft portion 24 of the vehicle 20. The vehicle 20 includes at least a portion 26 thereof which remains submerged during travel of the vehicle 20 through the water. When the vehicle 20 is a torpedo 22 (FIGS. 1 and 2) or other underwater vehicle (FIG. 3), the entire vehicle is underwater throughout at least a portion of the travel of the vehicle. However, in the case of surface vessels (FIG. 4), only a portion of the hull is underwater when the vessel is underway.

Figure 5:
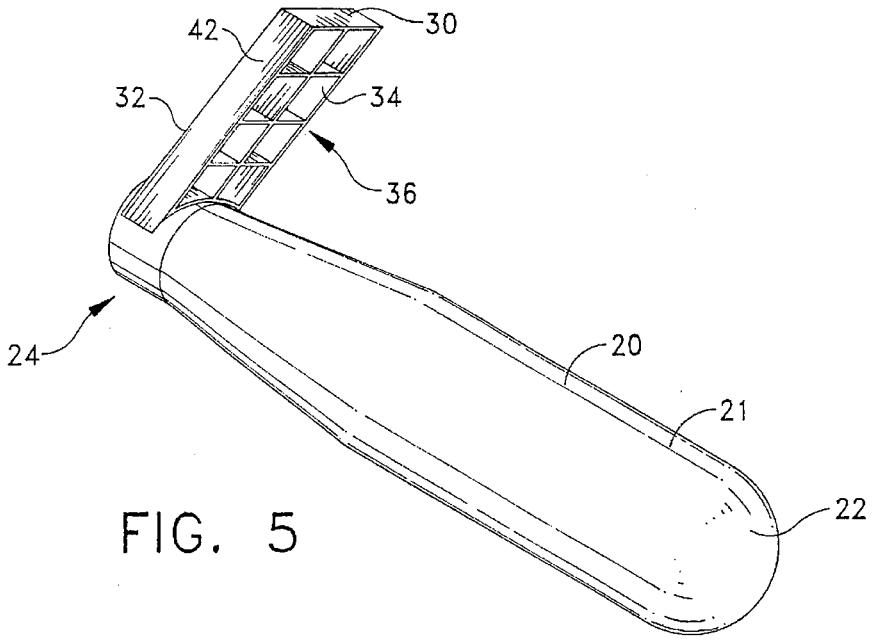
FIGS. 5–7 are illustrative of alternative embodiments, positionings, and single array usages of fin assemblies on underwater vehicles.
Figure 6:
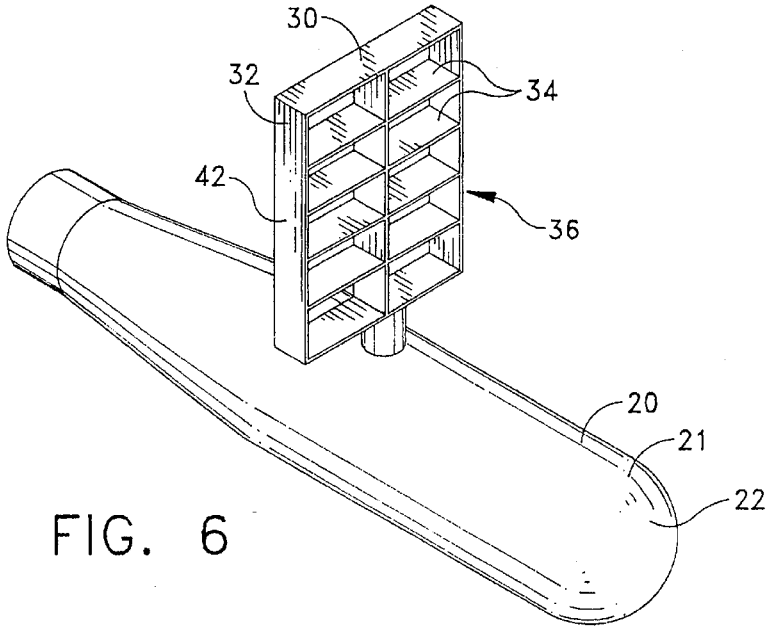
Figure 7:
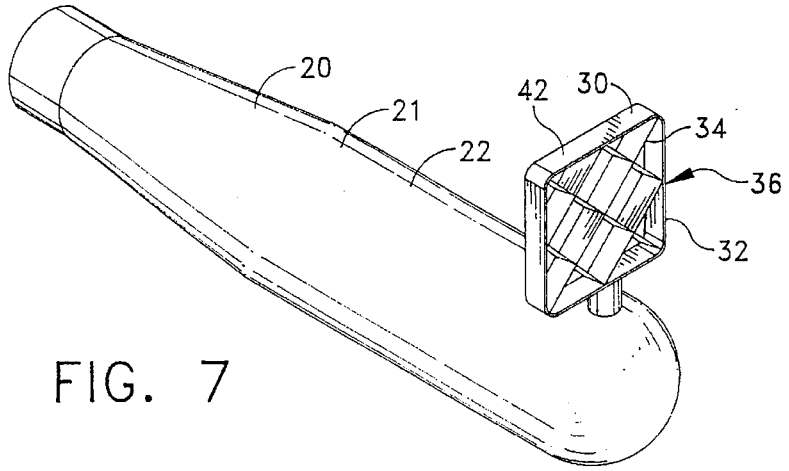

Referring to FIGS. 5–7, it will be seen that the control means 30 may comprise a single array 32 mounted at the aft portion 24 of the vehicle 20 (FIG. 5), generally amidships (FIG. 6), or near the bow (FIG. 7) of the vehicle 20. Each of the arrays 32 includes a multiplicity of fins 34 in a compact grouping for contact with the water through which the vehicle moves.

Figure 15:
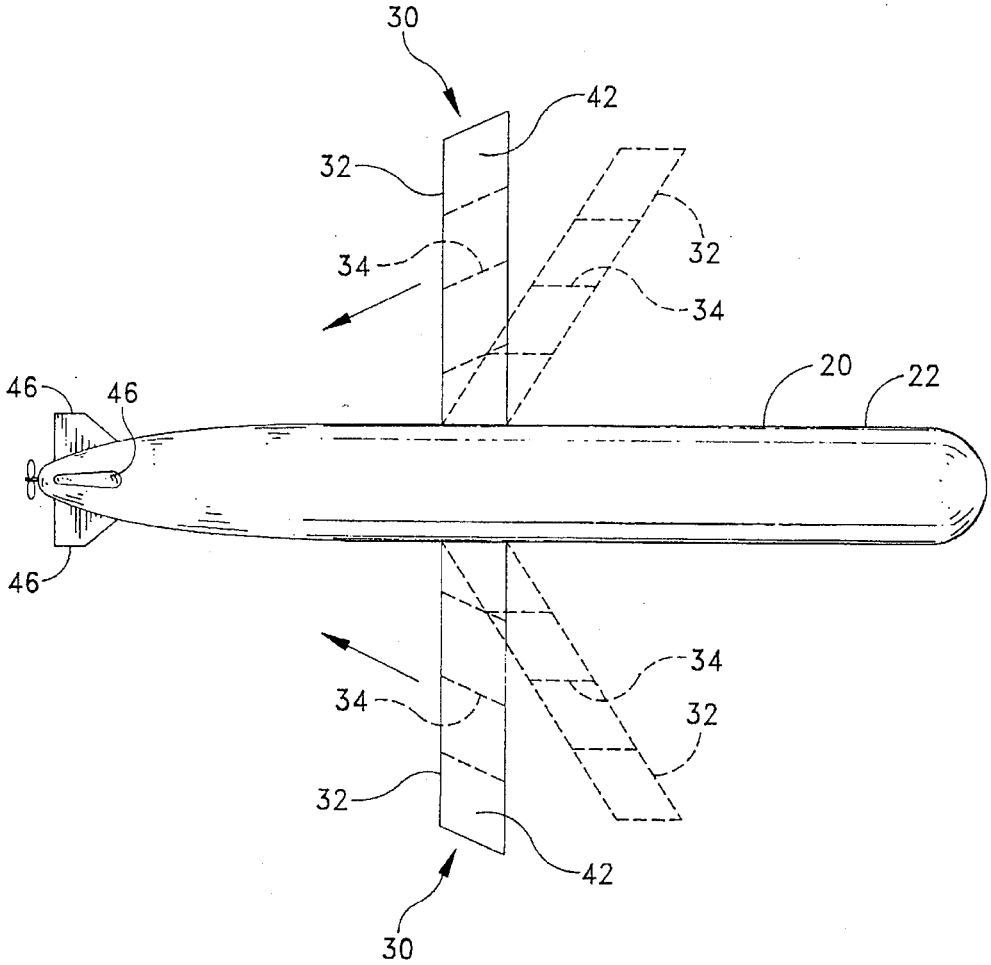
FIG. 15 is illustrative of an alternative embodiment of the invention and a pair of control fin assemblies mounted on an underwater vehicle and adapted for transition between two illustrated shapes.
Figure 16:
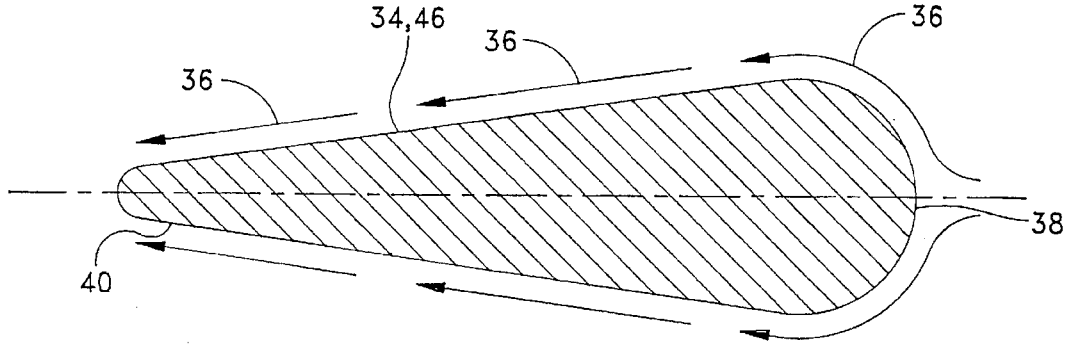
FIG. 16 is illustrative of a cross-section of a single fin which may be one of an array of fins, or may be a solitary fin for use independently of other fins or arrays of fins, as shown at the left hand end of FIG. 15.

Referring now to FIG. 16, each fin 34 preferably has a neutral-lift, uncambered, cross section chosen to substantially match the hydrodynamic streamlines about the fin present during movement of vehicle 20 through water at below-cavitation-threshold speed, represented by flow arrows 36. Such shape of streamlines is obtainable employing principles of analysis known by those having skill in the art. One such embodiment, shown in FIG. 16, has a cross sectional shape of an ellipsoidal leading edge 38 with a taper pinched trailing edge 40. A fin 46 as shown in FIG. 16 may be provided as one of an array of such fins or may be an independent single fin. Referring to FIG. 15 for example, the aftermost fins 46 may be at least in part of the aforementioned shape-memory material, such that the fins 46 may be modified in shape by application of electrical current thereto.

The array 32 of many relatively short fins 38 oriented generally in the direction of water flow about the vehicle, presents a large surface area when disposed at a selected angle to the flow. The device produces a high force/movement, even at low speeds.

The fins 34 may be surrounded by, and attached to, a shroud 42, as shown in FIGS. 1–7 and 9–15, or may, as is shown in the aforementioned related applications, be of a configuration wherein all ends of fins are fixed to the shroud, or wherein the shroud to which the fin ends are fixed does not surround the fins. The control assembly fins 34 may be mounted on a central post, with ends of the fins exposed. The fins 46 may be housed within a shroud, or disposed without a shroud, as shown in FIG. 15.

Figure 8:
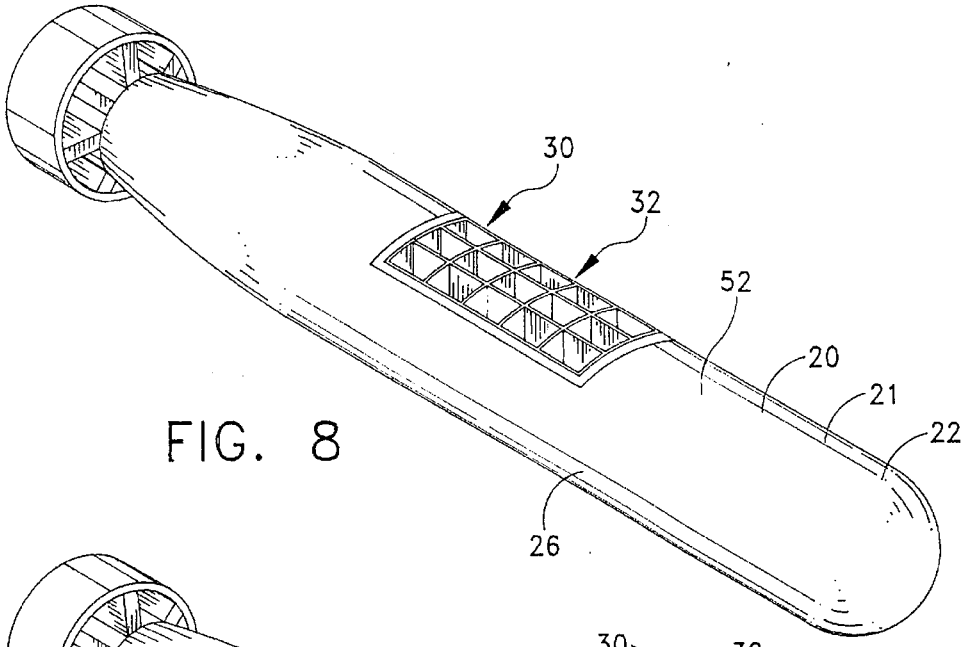
FIG. 8 is a perspective diagrammatic view of a control fin assembly illustrative of an embodiment of the invention, housed in an underwater vehicle.
Figure 9:
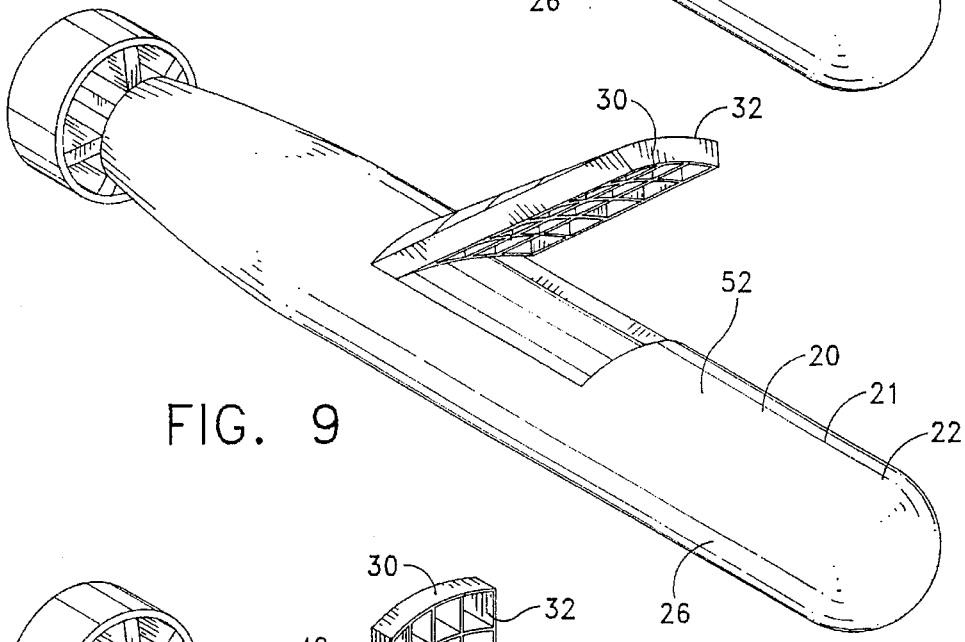
FIG. 9 is similar to FIG. 8, but illustrates the deployment of the fin assembly.
Figure 10:
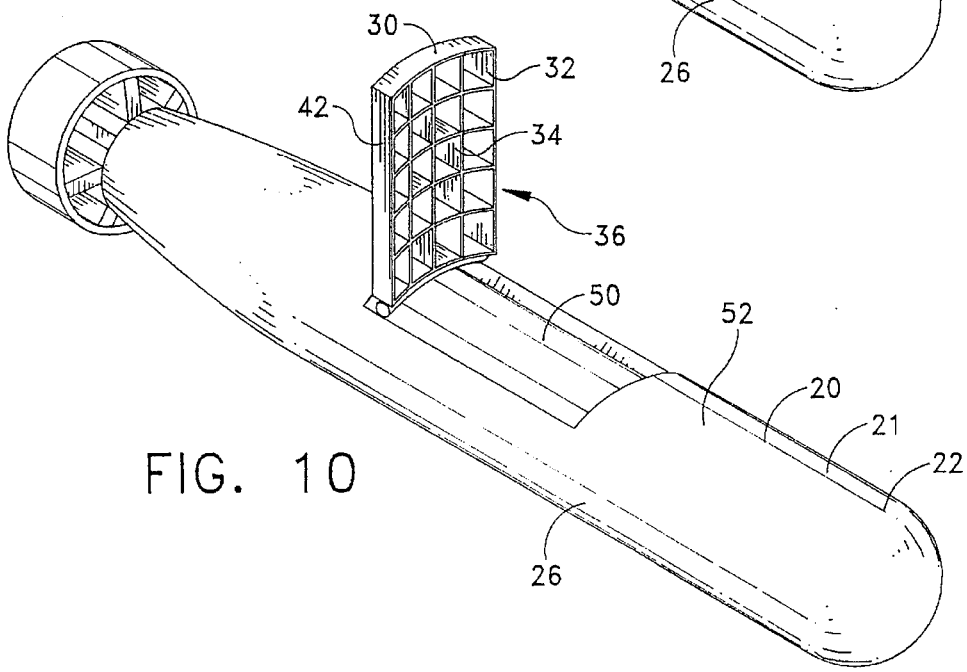
FIG. 10 is similar to FIG. 9, but illustrates the fin assembly fully deployed.

While the arrays 32 shown in FIGS. 1–7 and 10 extend outwardly, substantially normal to the axis of the vehicle, it will be seen in FIG. 5 that the array 32 of fins 34 may be extended in a position angled forwardly against the direction of water flow. The array may be curved, as shown in FIGS. 8–10.

As is shown in the related applications, the arrays 32 may be rotatably mounted on the vehicle and/or may be hingedly mounted, so as to be tiltable forwardly and/or rearwardly.

As illustrated in FIGS. 9 and 10, vehicle 20 preferably is provided with one or more pockets 50 in the underwater portion 26 thereof. The arrays 32 are movable between positions in pockets 50 wherein arrays 32 substantially conform to an exterior surface 52 of vehicle 20 (FIG. 8) and a deployed position wherein array 32 extends outwardly from exterior surface 52 of vehicle 20.

Figure 11:
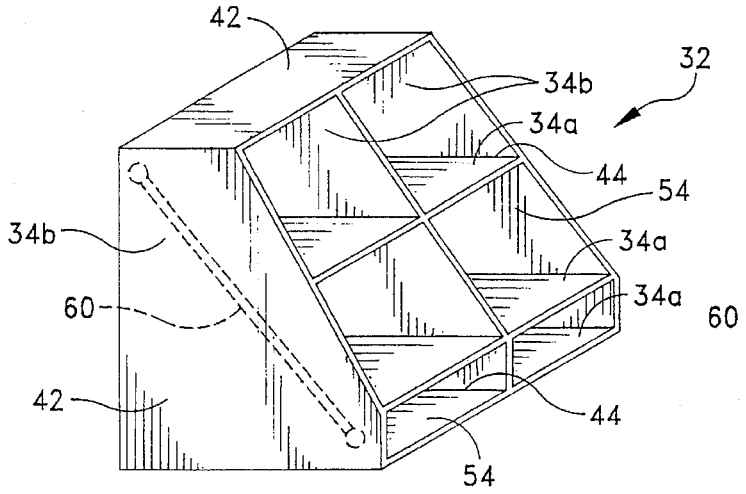
FIG. 11 shows one embodiment of control fin array.
Figure 13:
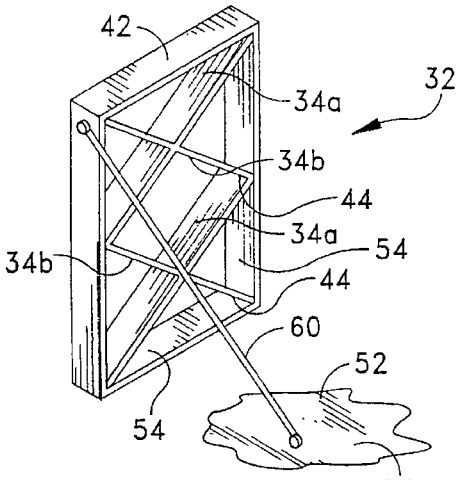
FIG. 13 shows an alternative embodiment of control fin array.

As seen in FIGS. 11 and 13, the array 32 of fins 34 may include a plurality of first fins **34*a* parallel to each other, and a plurality of second fins 34*b* parallel to each other and normal to first fins 34*a*. The first and second fins 34*a*, 34*b* intersect to form a grid-like configuration, with ends 44 of fins 34*a* and 34*b* fixed to an inside surface 54 of shroud 42**.

In the embodiment illustrated in FIGS. 8–10, arrays 32 may be extended by hydrodynamic forces acting thereon as vehicle 20 is launched, or may be extended by spring pressure which operates to fling arrays 32 to the deployed position upon exit of the vehicle from a launch tube. Alternatively, the arrays 32 may be selectively extended by power means operative upon signal from a transmitting station, or operable automatically upon lapse of a selected time, or the like.

In operation, during tube launch, or when vehicle 20 is moving at high speed, or when the arrays 36 are otherwise not needed, arrays 32 are folded conformal to the body of the vehicle 20 (FIG. 8) Upon deployment, the arrays present fins 34 substantially parallel to the direction of flow, minimizing drag. See FIG. 15, and particularly the arrays 32 shown in phantom. Yaw, pitch, and turning control forces may be imparted by angling the array with respect to flow, that is, by angling the array forwardly or rearwardly, or by rotating the array.

Alternatively, or in addition to such mechanical angling of arrays 32, a portion of each array may be of a shape memory material such as an alloy of nickel and titanium, known as "Nitinol". Nitinol is formable in such manner as to return to a "remembered" shape when heat is applied, as by an electric current. Alternatively, components of common piezoelectric materials and electrically inert substrates deform under the influence of an electric current. A device made from such materials can be made to twist, bend, extend, or contract under a controlled electrical input, or other heat source.

Figure 12:
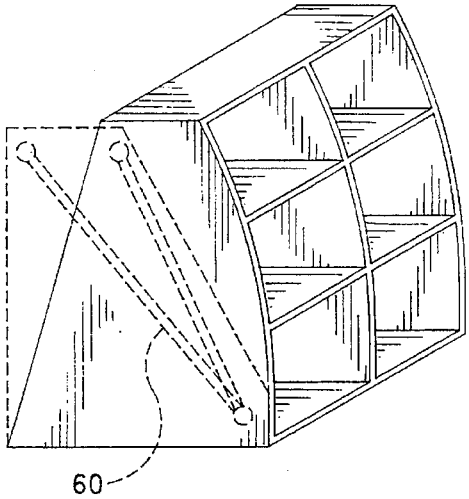
FIG. 12 shows the control fin array of FIG. 11 in its alternative shape.

In a preferred embodiment, shown in FIG. 11, a strand 60 of shape memory material is attached at its ends to different points on the array 32. Alternatively, the strand 60 may be embedded in a portion of the array 32, such as in the shroud 42. Upon application of electric current to strand 60, the strand compacts, or shortens, to alter the shape of the array (FIG. 12). In the embodiment shown in FIG. 15 at the aft end of the vehicle 20, the entire fin 46 may be of shape-memory material or only a portion thereof.

In an alternative preferred embodiment, shown in FIG. 13, the strand 60 is attached at one end to array 32 and at the other end to surface 52 of the vehicle 20. Upon application of electric current to strand 60, the strand compacts in length to pull the array 32 from the position shown in FIG. 13 and in phantom in FIG. 14, to the position shown in solid lines in FIG. 14.

In FIG. 15, there is illustrated amidship of a torpedo 22 arrays 32 movable between two shapes, a first forwardly leaning shape, shown in phantom in FIG. 15, and a second shape wherein the arrays are generally normal to the axis of the torpedo. In the forward leaning configuration, water flow through the arrays is substantially parallel to the axis of the torpedo. In the second configuration, the array fins are at an angle to the water flow and serve to slow movement of the torpedo. As will be apparent, by having one array forwardly and the other rearwardly, a turning of the torpedo is effected. Strands 60 of shape memory material (not shown in FIG. 15) may be utilized, as shown in FIGS. 11–14, to vary the shape of the arrays 32.

Figure 3:
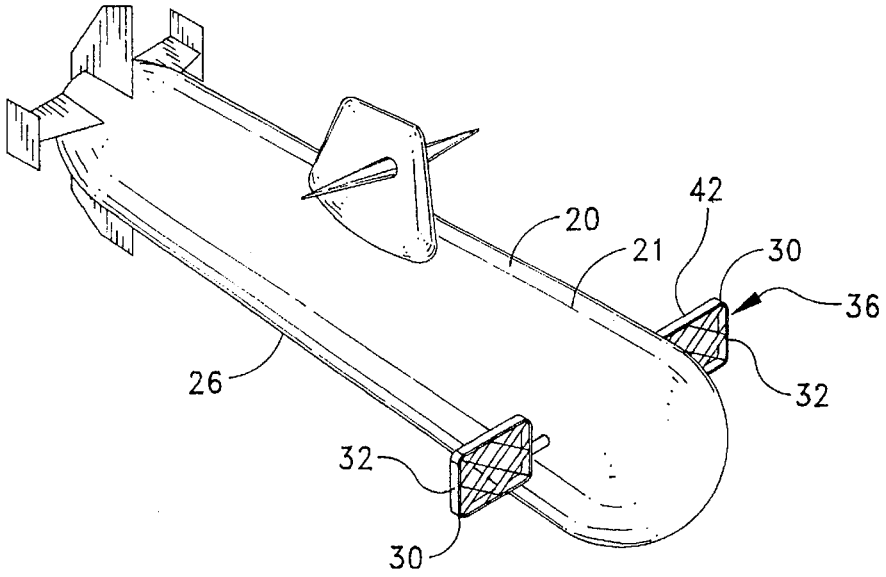
Figure 4:
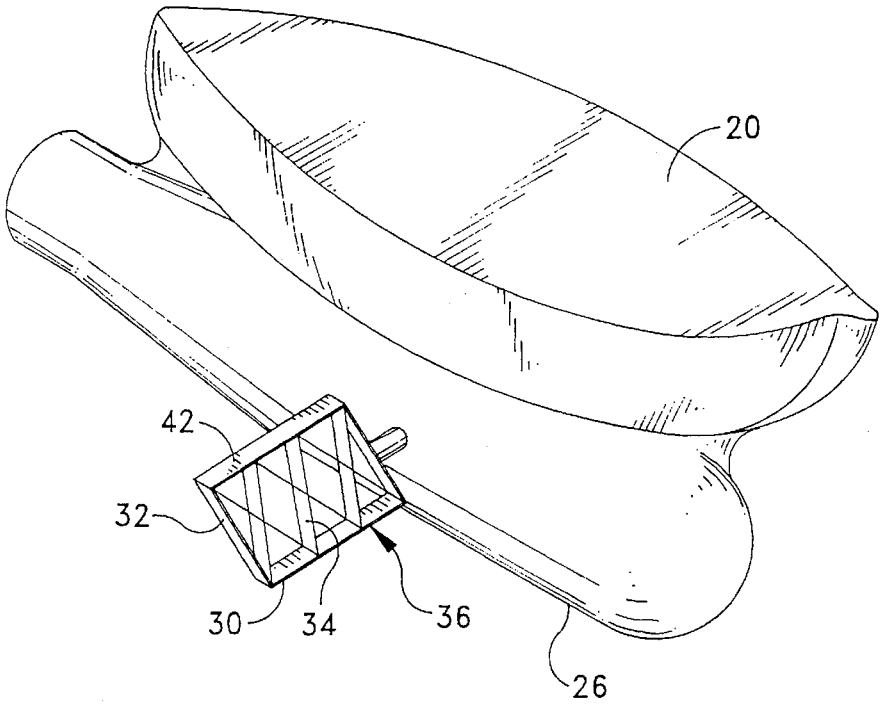
FIG. 4 illustrates a similar fin assembly mounted on a surface vessel hull underwater portion.

In underwater application, the vehicle mounts a symmetric arrangement of two or more shape-adaptive grid fin arrays (FIGS. 1–3 and 15), or a single large array (FIGS. 5–10), at tail (FIGS. 1 and 5), midbody (FIGS. 2, 6, 8–10 and 16), or bow positions (FIGS. 3 and 7). The fin arrays 32 are sized as appropriate to the drag, lift, and control needs of the specific vehicle. The array may be enclosed by a streamlined shroud, or open, with blade tips unsupported.

During tube launch, or at high speed, or when not needed, arrays 32 can be folded conformal to the vehicle body or otherwise retracted (FIG. 8). They can extend into the flow passively, as by hydrodynamic forces, or under the active force provided by a spring or motor. Deployed, the grid fin array 32 possesses a nominal angle of incidence to the flow, at which the fins 34 are parallel to the direction of the flow (FIG. 15) minimizing drag. The array can be built so that this nominal array angle is nonzero; in fact, the array itself may have a forward, backward, or sideways tilt, or have a curved profile.

Drag, yaw and pitch control forces are imparted by imparting control currents to the shape-adaptive materials, appropriately angling the array fins 34 with respect to the flow by deforming the entire structure, or by using the shape-adaptive material to alter the blade cross-sections of the fins 34 and/or the fins 46. The arrays can impart pitch-direction controlling forces in a manner analogous to conventional planar fins by twisting about their axes.

Figure 14:
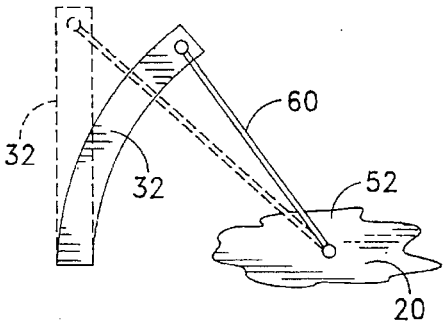
FIG. 14 shows the control fin array of FIG. 13 in its alternative shape.

Importantly, the shape-adaptive grid fin array can impart yaw controlling forces by bending fore and aft (FIG. 14). This additional function distinguishes grid fin arrays from planar fins; a vehicle can be controlled by a pair of grid fins only, provided they are capable of both fore/aft bending and axial twisting motion.

The vehicle can also be braked along its line of motion by bending the grid fin arrays forward or backward in the same direction (FIG. 15) so that off-axis control force components cancel. This function can be performed with arrangements of as few as two grid fin arrays, without imparting rolling forces.

The array may be angled forwardly or backwardly to catch or grab underwater cables, poles, or the like, in special applications, and fitted with cutting devices, telemetry interfaces, or latches at its base, discussed further herein.

The nominal cross sections of the fins 34 (FIG. 16) making up the grid fin array, and the independent fins 46, may take any streamlined shape consistent with incompressible hydrodynamic flow, and may be optimized for lift, drag, and/or captivation properties at the foreseen speed ranges of the vehicle. The choice of cross-section may vary from constituent blade to constituent blade, or even within a single blade, to accommodate the complex hydrodynamics of the array geometry.

The disposition of the shape-adaptive materials in the grid fin body can take several forms. The materials may be embedded in a flexible matrix during the manufacturing process, or assembled inside or outside the fin in order to impart the appropriate deformation. The shape-adaptive material units may be wire shaped and respond to control input primarily through elongation/contraction. More sophisticated designs may exploit a deformation field arising in the shape-memory/shape adaptive material. Additionally, the deformed shapes of the aggregate fin grid or individual fins may result either from the imposition of a control input, or from the absence of such an input.

Thus, there is provided a control fin assembly featuring a short-chord grid-fin array which permits high forces/moments at low speeds, simple operation, low power consumption, low acoustic signature, compatibility with a tube launch, and retractibility. There is further provided individually mounted and deformable fins.

In the aforementioned related patent applications Ser. Nos. 08/411,234, and 08/411,235, there are disclosed arrays of fins which are adapted to interconnect with underwater cables. The arrays described herein are adaptable for use as cable interconnect arms, as described in the '234, and '235, applications.

There is thus provided a water vehicle in combination with directional control means which afford high forces/moments at low speeds, simple operation, low power consumption, low acoustic signature and conformability to a launch tube.

It is to be understood that the present invention is by no means limited to the particular construction herein disclosed and shown in the drawings, but also comprises any modifications or equivalents with the scope of the claims. For example, while several specific arrangements of fins are illustrated, the fin arrays may be of any shape consistent with incompressible hydrodynamic flow, and may be optimized for lift, drag and/or cavitation properties of a particular vehicle at foreseen speed ranges.

What is claimed is:

1. A control fin assembly for a water vehicle, the assembly comprising:

a multiplicity of fins connected together and grouped in an array mounted on the vehicle, said array including a plurality of first fins parallel to each other, and a plurality of second fins parallel to each other and transverse to said first fins, said first and second fins intersecting to form a grid-like configuration;

a shroud surrounding said fins and to which ends of said fins are fixed;

a strand of shape-memory material embedded at both ends and therebetween in said shroud and extending through said shroud between separated parts of said shroud; and whereby upon actuation of the shape-memory of said material, said strand changes in length to deform said shroud and thereby change positions of said fins relative to a hull portion of said water vehicle.

2. A control fin assembly for a water vehicle, the assembly comprising:

a multiplicity of fins connected together and grouped in an array mounted on the vehicle, said array including a plurality of first fins parallel to each other, and a plurality of second fins parallel to each other and transverse to said first fins, said first and second fins intersecting to form a grid-like configuration;

a shroud surrounding said fins and to which ends of said fins are fixed;

a strand of shape-memory material fixed at one end to said shroud and at the other end to a surface portion of said vehicle on which said array is mounted; and whereby upon actuation of the shape-memory of said material, said strand changes in length to deform said shroud and thereby change positions of said fins relative to said surface portion of said water vehicle.

* * * * *